United States Patent [19]

Hedberg

[11] Patent Number: 4,530,266

[45] Date of Patent: Jul. 23, 1985

[54] CUTTING UNIT WITH CHAIN SAW FOR CUTTING LOGS

[75] Inventor: Allan Hedberg, Söderhamm, Sweden

[73] Assignee: Stensele Mekaniska Verkstad AB, Soderhamn, Sweden

[21] Appl. No.: 560,227

[22] Filed: Dec. 12, 1983

[30] Foreign Application Priority Data

Jan. 4, 1983 [SE] Sweden ..... 8300035

[51] Int. Cl.[3] ..... B27B 17/00

[52] U.S. Cl. ..... 83/801; 83/796; 83/563

[58] Field of Search ..... 83/798, 796, 797, 801, 83/563

[56] References Cited

U.S. PATENT DOCUMENTS 2,755,570 7/1956 Blackburn et al. ..... 83/796 X 2,756,784 7/1956 Cheren ..... 83/797

4,245,535 1/1981 Lockwood et al. ..... 83/798

*Primary Examiner*—Donald R. Schran

*Attorney, Agent, or Firm*—Stevens, Davis, Miller & Mosher

[57] ABSTRACT

A unit intended for cutting logs includes a body and a chain saw carried by the body, the saw being adapted for displacement in one direction, from an initial position before cutting to an end position after cutting, and in the opposite direction, from said end position to the initial position once again, the unit also having means for carrying out the displacement from said end position after cutting to the initial position once again, such that during the latter displacement no part of the cutting bar will be in the way of the log, for an axial movement of the log initiated immediately after the cutting operation.

10 Claims, 4 Drawing Figures

CUTTING UNIT WITH CHAIN SAW FOR CUTTING LOGS

Figure 1:
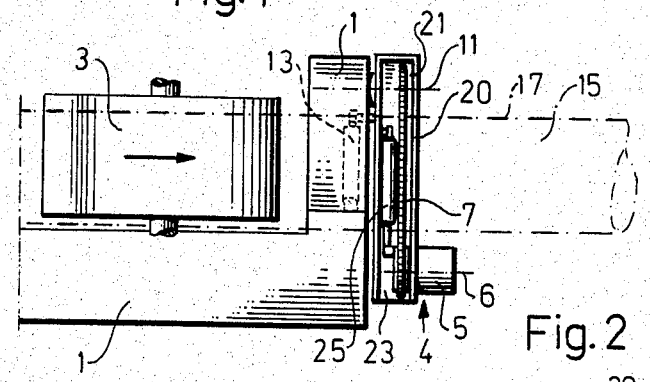

In processing units for lopping and cutting tree trunks the cutting process is at present mainly performed by chain saws. However, there is often the problem that after the cut has been made during the movement of the saw in the sawing direction the saw chain bites into the log during the return movement, which can cause chain rupture and the like. It is also known to let the cutting bar, after the log has been cut through, to continue its circular movement in the same direction back to its initial position, but then there occurs the problem of providing protection for the cutting bar during the whole of this movement instead.

The present invention relates to an apparatus enabling the return of the cutting bar to its initial position after cutting, and in the opposite direction to the sawing direction, without it coming into contact with the log during the return movement or preventing the continued forward feed of the log.

It will thus be possible, immediately after cutting a log section, to begin the further forward feed of the log without needing to wait for the cutting bar to return to its initial position. This means an increase in logging capacity, since the stoppage in throughput for the associated processing machine caused by the time required for cutting is restricted to the time for the effective cutting operation. Furthermore, the risks of chain breakage and chain jumping are decreased with the described apparatus, since the cutting bar does not need to pass the saw cut during the return movement, thus risking being caught in the splinters etc. around the face of the cut.

A unit in accordance with the invention for cutting logs includes a body and a chain saw carried by it, the saw being disposed for enabling its displacement in one direction, from an initial position before cutting to an end position after cutting, and in the opposite direction, from the latter end position to the initial position once again, and is characterized by means for carrying out the displacement, from the mentioned end position after cutting and back to the initial position, such that during the latter displacement no part of the cutting bar will be in the way of the log for an axial movement of the log started immediately after the cutting process.

The cutting bar is suitably pivotably mounted on a holder movably mounted on the unit body, and adapted for being displaced between a first position, in which the cutting bar can make the cut during pivoting in one direction from its initial position, and another position in which the cutting bar can be returned to its initial position during pivoting in the opposite direction, without getting in the way of the advancing log.

For this purpose the holder may be pivotably mounted on the body of the unit and adapted for being moved about its pivoting axis between its first and second end positions. The pivoting axis for the holder can suitably be parallel to or transverse to the log, inter alia depending on in which direction there is space available for the return movement of the cutting bar in each individual case.

The invention will now be described in detail in the following in conjunction with the appended drawings, which schematically illustrate a pair of embodiments of an inventive unit intended for cutting logs.

Figure 2:
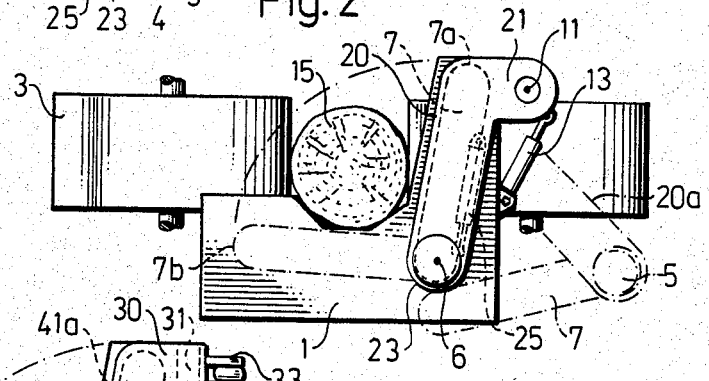
Figure 3:
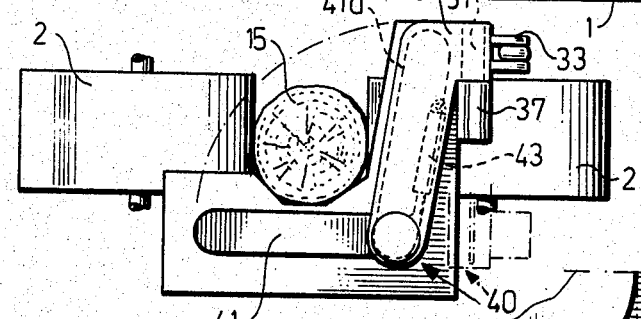
Figure 4:
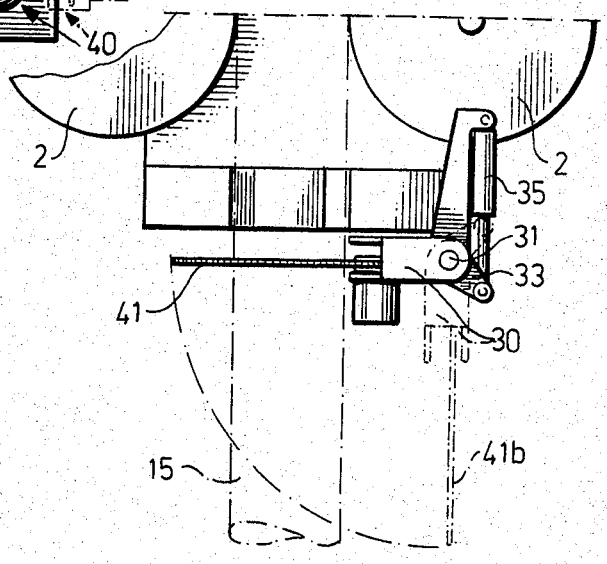

FIGS. 1 and 2 illustrate the unit in accordance with a first embodiment, as seen in elevation and at right-angles to the log, respectively, while FIGS. 3 and 4 illustrate the unit in accordance with a second embodiment seen at right angles to the log and from above, respectively.

The cutting unit includes a supporting body 1, having driven feed rollers 3 for advancing the log 15 in the direction of the arrow in FIG. 1. A carrying arm 20 in the form of a saw housing is pivotably mounted at one of its ends 21 in the body 1, about a shaft 11 extending substantially parallel to the log 15, and is situated in a horizontal plane lying above the log. The arm 20 is adapted for swinging about the shaft 11 with the aid of a hydraulic cylinder 13 coupled between the body 1 and arm 20. At its free end 23 this arm carries a chain saw 4, which includes a cutting bar mounted about a shaft 6 parallel to the pivoting shaft 11 of the arm 20. The saw chain is driven by a hydraulic motor 5. The cutting bar 7 is adapted for pivoting about the shaft 6 with the aid of a hydraulic cylinder 25 coupled between the fastening of the cutting bar 7 and the arm 20.

The function of the cutting unit will now be described with reference to FIG. 2.

Before the cutting operation, the carrying arm or saw housing 20 is in a first end position close to the log 15 indicated by full lines in FIG. 2. The cutting bar 7 is then in its initial position denoted by the dashed line **7*a*. The log 15 is cut by the cutting bar being pivoted counter-clockwise according to FIG. 2 with the aid of the hydraulic cylinder 25, until the cutting bar comes to its end position denoted by the dashed line 7*b* under the log, whereon the hydraulic motor 5, and thus the saw chain, is stopped. The cut-off log section falls down and the carrying arm 20 is simultaneously pivoted counter-clockwise from its above-mentioned first end position close to the log to a second end position farther away from the log and denoted by the dash-dotted line 20*a*. During this pivoting movement, a clockwise pivoting movement of the cutting bar 7 relative the carrying arm is initiated with the aid of the hydraulic cylinder 25, for returning the cutting bar to its initial position. When this has been achieved, or just before it, the carrying arm is returned to its first end position by being pivoted clockwise with the aid of the hydraulic cylinder 13**.

It will be seen from FIG. 2 that during the clockwise pivoting of the bar to its initial position the free end of the cutting bar 7 will pass to one side of the log 15, so that no part of the bar will prevent further advance of the log 15 immediately after the described cutting operation has been carried out, i.e. when the cutting bar has come to its lower end position **7*b***. By the cutting bar in its entirety being returned to its initial position via a path spaced from the side of the log, there is no risk of the saw chain coming into contact during the return movement with splinters or the like at the cut face of the log.

Since the log can be advanced once again immediately after cutting off a log section in the manner described above, a saving in time is achieved, which is reflected in a corresponding increase in the processing capacity of the cutting unit, which is of great importance, not least in the cases where the unit forms a part of a modern forest processor burdened with large investment costs.

The illustrated and described embodiment represents only one of several possible embodiments of a unit in accordance with the invention. Thus, it may be mentioned that the holder for the chain saw, instead of being pivotable about a shaft 11 parallel to the log as in FIG. 2, may be mounted on the unit body about a shaft transverse to the log, e.g. a vertical shaft, about which the holder is pivotable between a first end position, in which the cutting bar is at right-angle to the log and in which the cutting operation can be performed, and a second end position, e.g. in which the cutting bar can extend parallel to the log, and in which the cutting bar can be returned along one side of the log to its initial position, i.e. without coming in the way of the log when this is once again advanced after the cutting-off operation.

An embodiment of this type is illustrated schematically in FIGS. 3 and 4. In FIG. 3, which illustrates the cutting unit seen towards the advancing direction of the log, a saw housing is denoted by the numeral 30 and with the aid of a vertical shaft 31 is mounted at its upper part on the body 37 of the unit. The saw housing can be pivoted about this shaft with the aid of a hydraulic motor 35 coupled between the body and a pair of projections 33 on the saw housing. A chain saw 40 is mounted at the lower part of the housing and has a cutting bar 41, which can be pivoted, with the aid of a hydraulic motor 43, between an upper starting position 41*a* denoted by a dashed line in FIG. 2, and a lower end position in which the cutting bar in its entirety is below the cut-off log.

After the cutting operation when the cutting bar has come into this lower end position illustrated by full lines in FIGS. 3 and 4, the saw housing is pivoted by the hydraulic motor 35 to its position illustrated in the Figures with dash dotted lines. The cutting bar is now in the position denoted by 41*b* and extends substantially parallel to the advancing path of the log, such that it can once again be returned to the initial position 41*a* without obstructing, or being obstructed by, the further advance of the log, which starts immediately after the cutting operation.

It is also possible to mount the holder for the chain saw such that it is displaceable on guides or the like towards, and away from, the log to enable the return to one side of the log of the cutting bar.

In conclusion it may be mentioned that unillustrated mechanical and electrical means, known per se, can be arranged for automatic return of the cutting bar from its end position after the cutting operation to its initial position, as soon as the cutting operation has been carried out.

I claim:

1. A unit for cutting a log across its length, comprising a body having means for holding a log and moving the log lengthwise;

a holder movably mounted on said body;

a chain saw having a cutting bar pivotably mounted on said holder, said holder being movable between a first position in which said cutting bar is pivotable in one direction from an initial position for carrying out a cutting operation, and a second position in which said cutting bar is pivotable in an opposite direction to be returned to said initial position without getting in the way of a log which is advancing lengthwise immediately after the cutting operation.

2. Unit as claimed in claim 1 in which the holder is pivotably mounted on said body about a shaft substantially parallel to the log and adapted for being displaced between said first and said second end position by pivoting about said shaft.

3. Unit as claimed in claim 1 in which the holder is pivotably mounted on said body about a shaft transverse to the log and adapted for being displaced between said first and said second end positions by pivoting about said shaft.

4. Unit as claimed in claim 3 in which the pivoting axis of the holder extends in a plane substantially perpendicular to the log.

5. Unit as claimed in claim 4 in which the pivoting axis of the holder is substantially vertical.

6. Unit as claimed in claim 4 in which the pivoting axis of the holder is substantially horizontal.

7. Unit as claimed in claim 2 in which the holder is mounted on said body, such as to be displaceable to and from the log between its first and second positions.

8. Unit as claimed in claim 2 in which the pivoting axis of the holder is situated in a substantially horizontal plane about the log.

9. Unit as claimed in claim 1 including hydraulic means for displacing the holder between its first and second positions.

10. Unit as claimed in claim 2 including means for automatically displacing the holder from its second to its first position as soon as the cutting operation is completed.

* * * * *